US011309657B1

(12) United States Patent
Lai et al.

(10) Patent No.: US 11,309,657 B1
(45) Date of Patent: Apr. 19, 2022

(54) BLADE TYPE ELECTRICAL CONNECTOR

(71) Applicants: Austin Lai, Taichung (TW); Chi-I Lai, Taichung (TW); Chao-I Chien, Taichung (TW)

(72) Inventors: Austin Lai, Taichung (TW); Chi-I Lai, Taichung (TW); Chao-I Chien, Taichung (TW)

( * ) Notice: Subject to any disclaimer, the term of this patent is extended or adjusted under 35 U.S.C. 154(b) by 0 days.

(21) Appl. No.: 17/196,208

(22) Filed: Mar. 9, 2021

(51) Int. Cl.
*H01R 13/11* (2006.01)
*H01R 13/52* (2006.01)
*H01R 13/629* (2006.01)

(52) U.S. Cl.
CPC ..... *H01R 13/521* (2013.01); *H01R 13/11* (2013.01); *H01R 13/5213* (2013.01); *H01R 13/629* (2013.01)

(58) Field of Classification Search
CPC .. H01R 13/521; H01R 13/11; H01R 13/5213; H01R 13/629
See application file for complete search history.

(56) References Cited

U.S. PATENT DOCUMENTS

| | | | | |
|---|---|---|---|---|
| 10,276,972 | B1 * | 4/2019 | Lai | H01R 13/521 |
| 10,992,074 | B2 * | 4/2021 | Deng | H01R 13/113 |
| 11,081,825 | B1 * | 8/2021 | Lai | H01R 13/64 |
| 11,128,077 | B1 * | 9/2021 | Lai | H01R 24/76 |

* cited by examiner

*Primary Examiner* — Tho D Ta
(74) *Attorney, Agent, or Firm* — Che-Yang Chen; Law Office of Michael Chen

(57) ABSTRACT

A blade type electrical connector may include a first connecting member and a second connecting member. The first connecting member has an end surface, and a plurality of blades protrude therefrom. A waterproof mat coupled on the end surface has a plurality of first through holes penetrated by the blades. A plurality of protruding portions protruding from the waterproof mat are respectively coupled around the blades, and each two adjacent protruding portions are separated by an interval surface. The box-shaped second connecting member comprises a first surface, and a plurality of receiving slots are formed on the first surface and extended into the inner space of the second connecting member, and each of the receiving slots has a conductive terminal installed therein. The second connecting member comprises a plurality of interval bars, and each of the interval bars located between two adjacent receiving slots extendedly protrudes from the first surface.

9 Claims, 10 Drawing Sheets

BLADE TYPE ELECTRICAL CONNECTOR

FIELD OF THE INVENTION

The present invention relates to an electrical connector and more particularly to a blade type electrical connector with improved water resistance.

BACKGROUND OF THE INVENTION

As various electronic equipment needs to connect various circuits such as power supply and signal, it is common to have male and female connectors at both ends of the wire, and then the electrical connection is done through the quick connection between the male connector and the female connector. The conventional blade type electrical connector has conductive blades with elastic pieces to achieve the advantages of high structural strength, high conductive area and wide operation angle range.

However, the conventional blade type electrical connector has following disadvantages: in order to achieve the above advantages, the female connector is provided with L-shaped right angle slot to allow the blade of the male connector to insert into the slot straightly, and the opening of the slot needs to be manufactured in larger size, which leads to insufficient water resistance. Therefore, there remains a need for a new and improved design for a blade type electrical connector to overcome the problems presented above.

SUMMARY OF THE INVENTION

The present invention provides a blade type electrical connector comprising a first connecting member and a second connecting member. The first connecting member has an end surface, and a plurality of blades protrude from the end surface. A waterproof mat coupled on the end surface has a plurality of first through holes at positions corresponding to the blades so as to allow the blades to penetrate therethrough. A plurality of protruding portions protruding from the surface of waterproof mat are respectively coupled around the outer peripheries of the blades, and each two adjacent protruding portions are separated by an interval surface. The second connecting member, which is formed in box shape, comprises a first surface at one surface thereof, and a plurality of receiving slots are formed on the first surface and extended into the inner space of the second connecting member, and each of the receiving slots has a conductive terminal installed therein. The second connecting member comprises a plurality of interval bars, and each of the interval bars located between two adjacent receiving slots extendedly protrudes from the first surface. A blocking wall is provided to surround along the four edges of the first surface so as to cover the first surface, the receiving slots, the conductive terminals, and the interval bars. The blocking wall is lateral extended to form a frame which is protruded at position outwardly than the interval bars.

In one embodiment, the second connecting member has a second surface at the opposed side of the first surface, and the second surface is penetrated through by the receiving slots, and a protruding wall is provided to surround along the four edges of the second surface, and a first cover is coupled with the protruding wall.

In another embodiment, a plurality of engaging holes are formed on the protruding wall, and the edge of the first cover has a plurality of engaging blocks at positions corresponding to the engaging holes; and the first cover is coupled with the inner periphery of the protruding wall, and the engaging blocks are engaged with the engaging holes.

In still another embodiment, an elastic spacer is coupled between the second surface of the second connecting member and the first cover, and the spacer is compressed and elastically deformed by the first cover to firmly abut against the second surface.

In a further embodiment, the edge of the protruding wall has a plurality of cutting portions aligned with the receiving slots, and each of the conductive terminals has a pin extended therefrom such that as the conductive terminals are installed in the receiving slots, the pins respectively pass through the cutting portions and are positioned out of the second connecting member.

In still a further embodiment, the edge of the first cover comprises a plurality of blocking pieces at positions corresponding to the cutting portions of the protruding wall, and the blocking pieces are adapted to respectively fit into the cutting portions when the first cover is coupled in the protruding wall.

In an advantageous embodiment, a locating base protrudes from the end surface of the first connecting member, and the blades penetrate through the locating base; and the surface of the waterproof mat faced to the end surface of the first connecting member has a concaved locating slot, and the locating base is coupled and secured in the locating slot.

In a preferred embodiment, each of the receiving slots of the second connecting member has two guiding inner walls formed in parallel and located between the first surface and the conductive terminal, and the guiding inner wall is inclined from the first surface toward the conductive terminal.

In another preferred embodiment, as the first connecting member and the second connecting member are coupled and electrically connected, the waterproof mat is coupled therebetween, and only the blades make contact with the conductive terminals.

Comparing with conventional blade type electrical connector, the present invention is advantageous because: (i) the present invention of the blade type electrical connector comprises the frame, the waterproof mat, the interval bars, the interval surface, and the protruding portions to form multiple waterproof protections; (ii) as the first connecting member and the second connecting member are electrically connected, the waterproof mat is coupled therebetween, and only the blades make contact with the conductive terminals, so that the friction between the first connecting member and the second connecting member is effectively reduced so as to improve the operation the insertion and disconnection; and (iii) each of the receiving slots of the second connecting member has the two guiding inner walls formed in parallel and located between the first surface and the conductive terminal, and the guiding inner wall is inclined from the first surface toward the conductive terminal such that the receiving slots are applicable for wider insertion angles of the blades.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
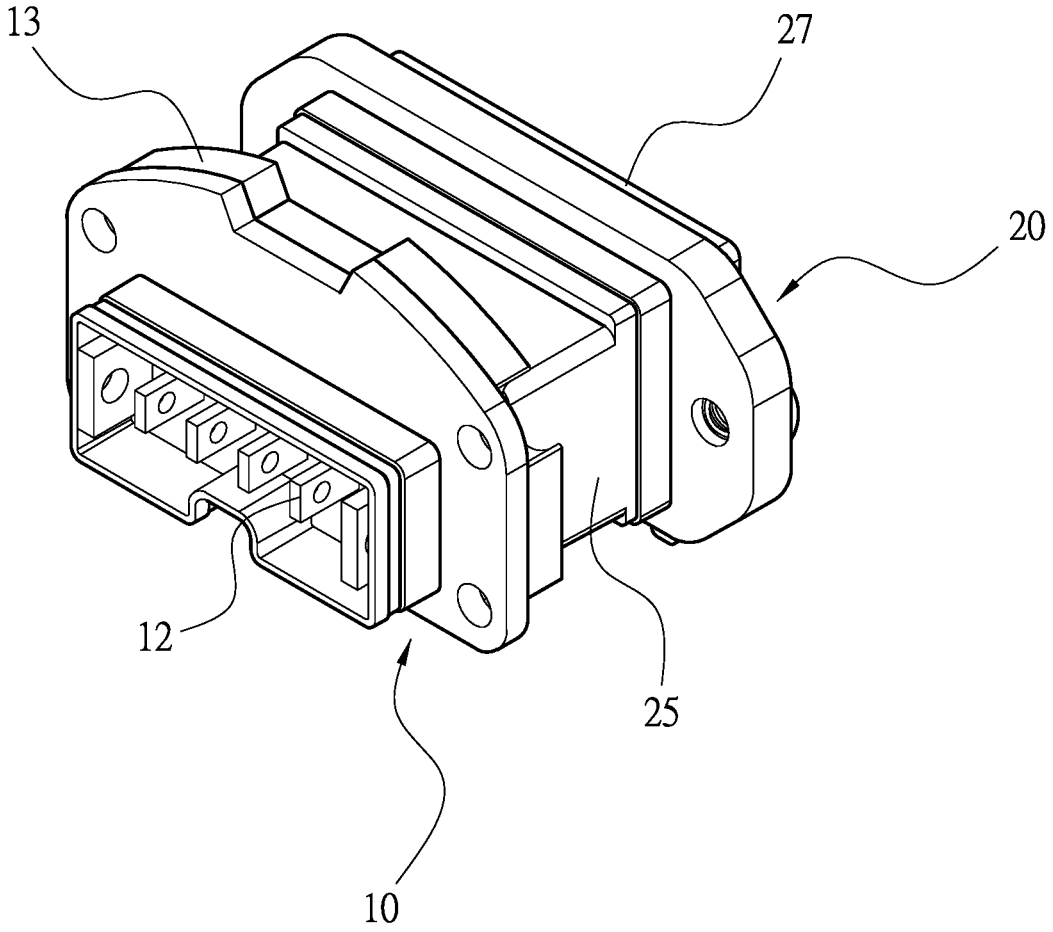
FIG. 1 is a three-dimensional assembly view of a blade type electrical connector of the present invention.
Figure 2:
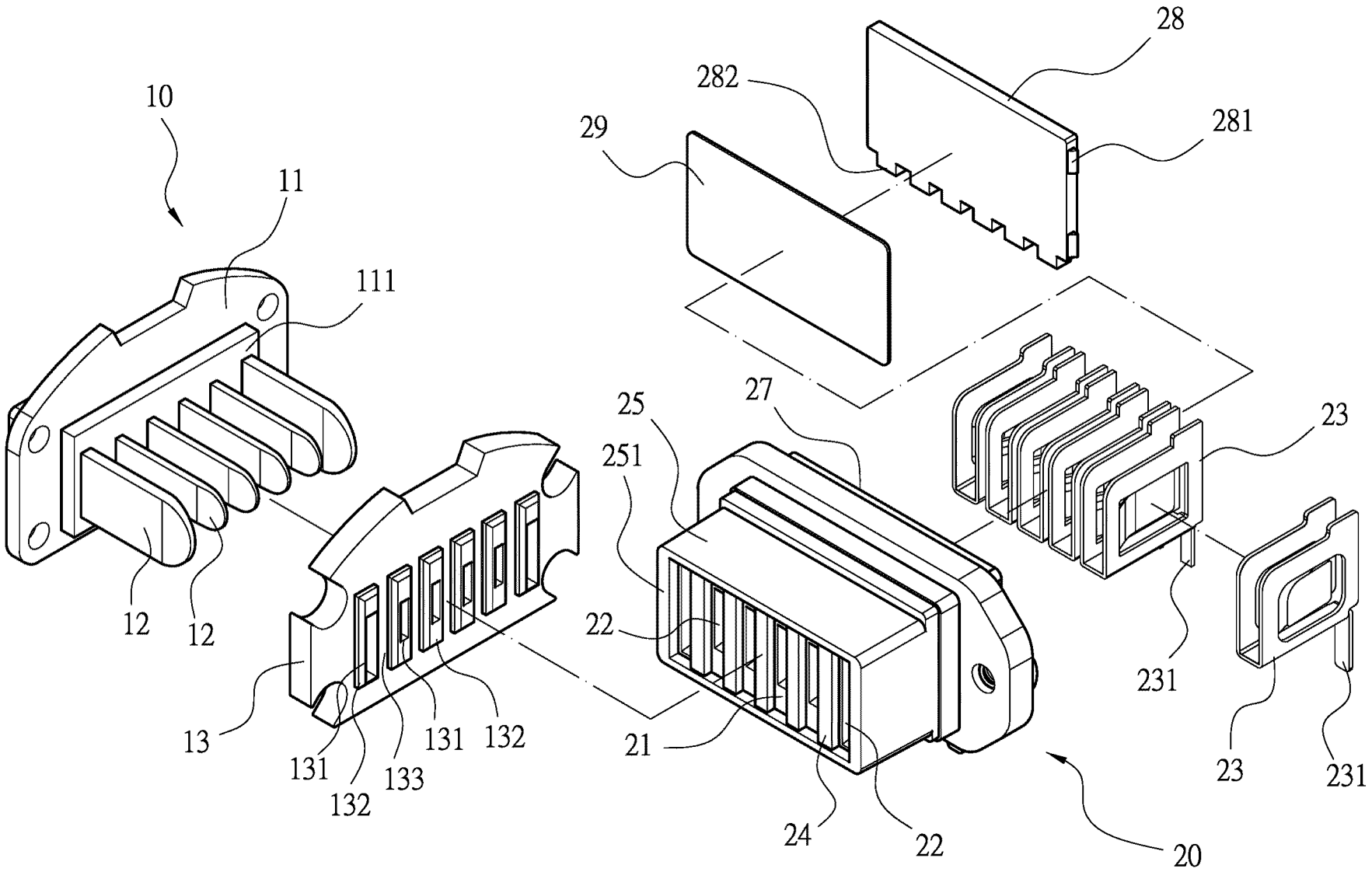
FIG. 2 is a three-dimensional exploded view of the blade type electrical connector of the present invention.
Figure 3:
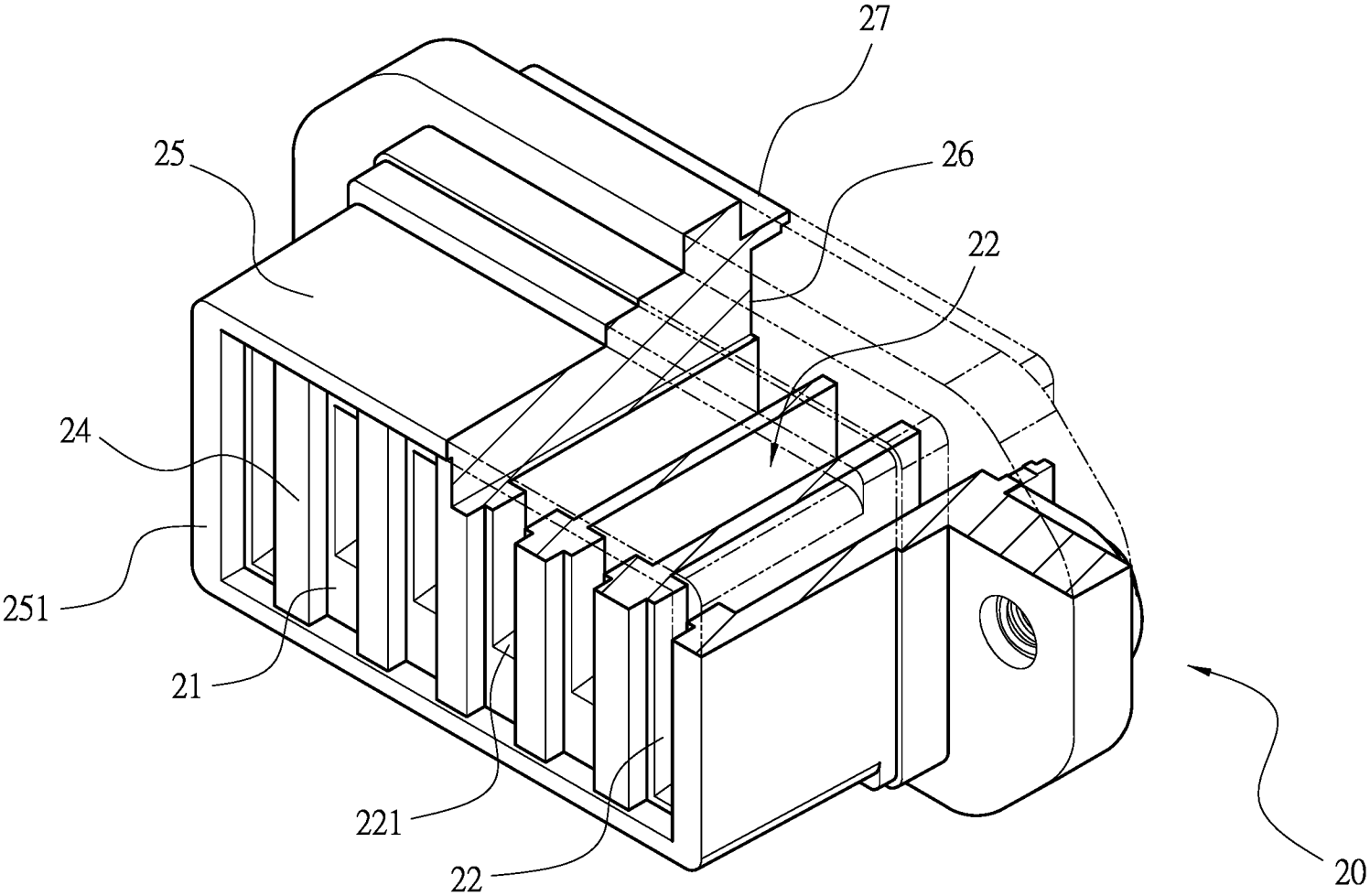
FIG. 3 is a detailed sectional view of a second connecting member of the blade type electrical connector in the present invention.
Figure 4:
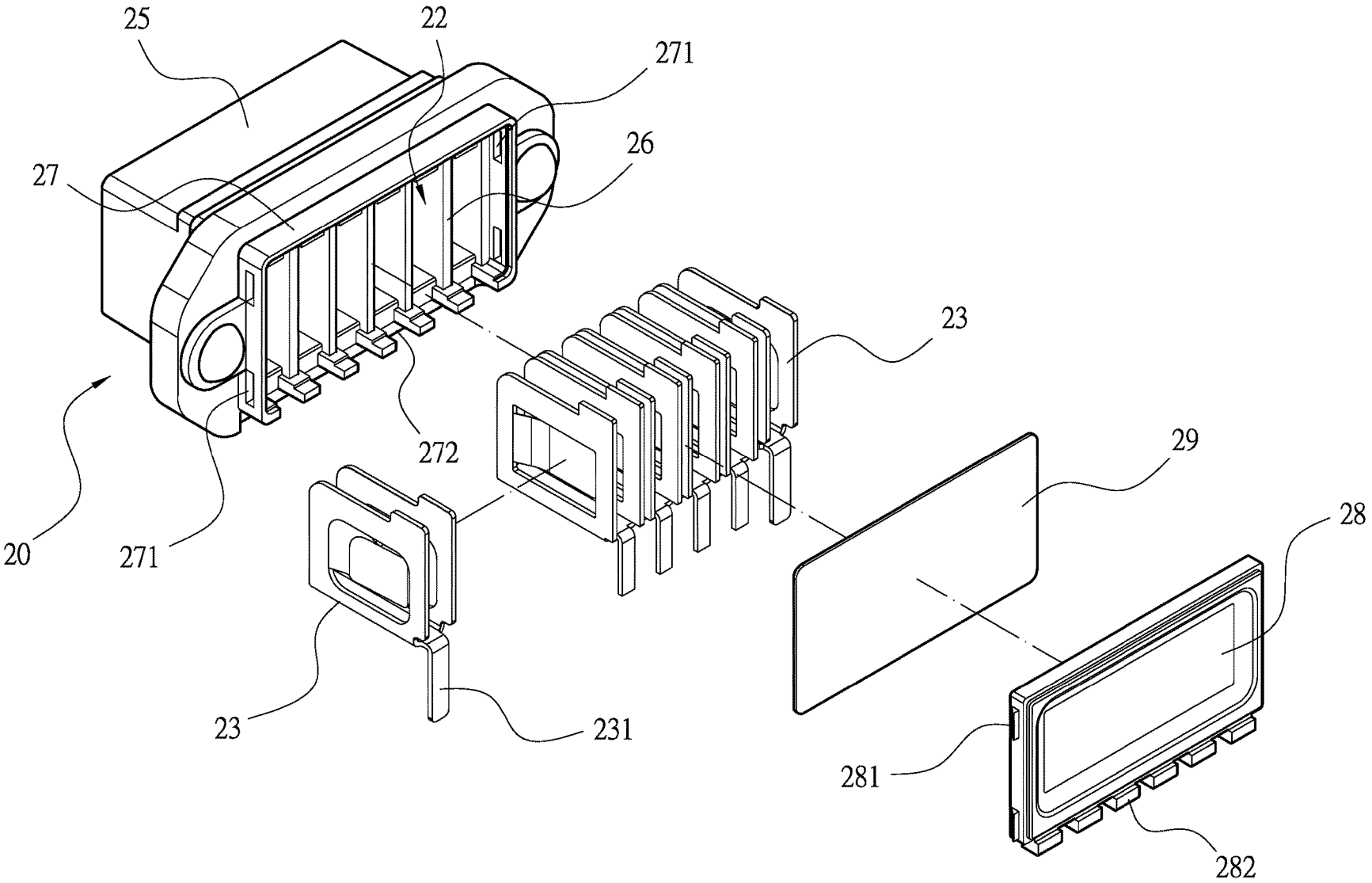
FIG. 4 is a three-dimensional exploded view of the second connecting member of the blade type electrical connector in the present invention.
Figure 5:
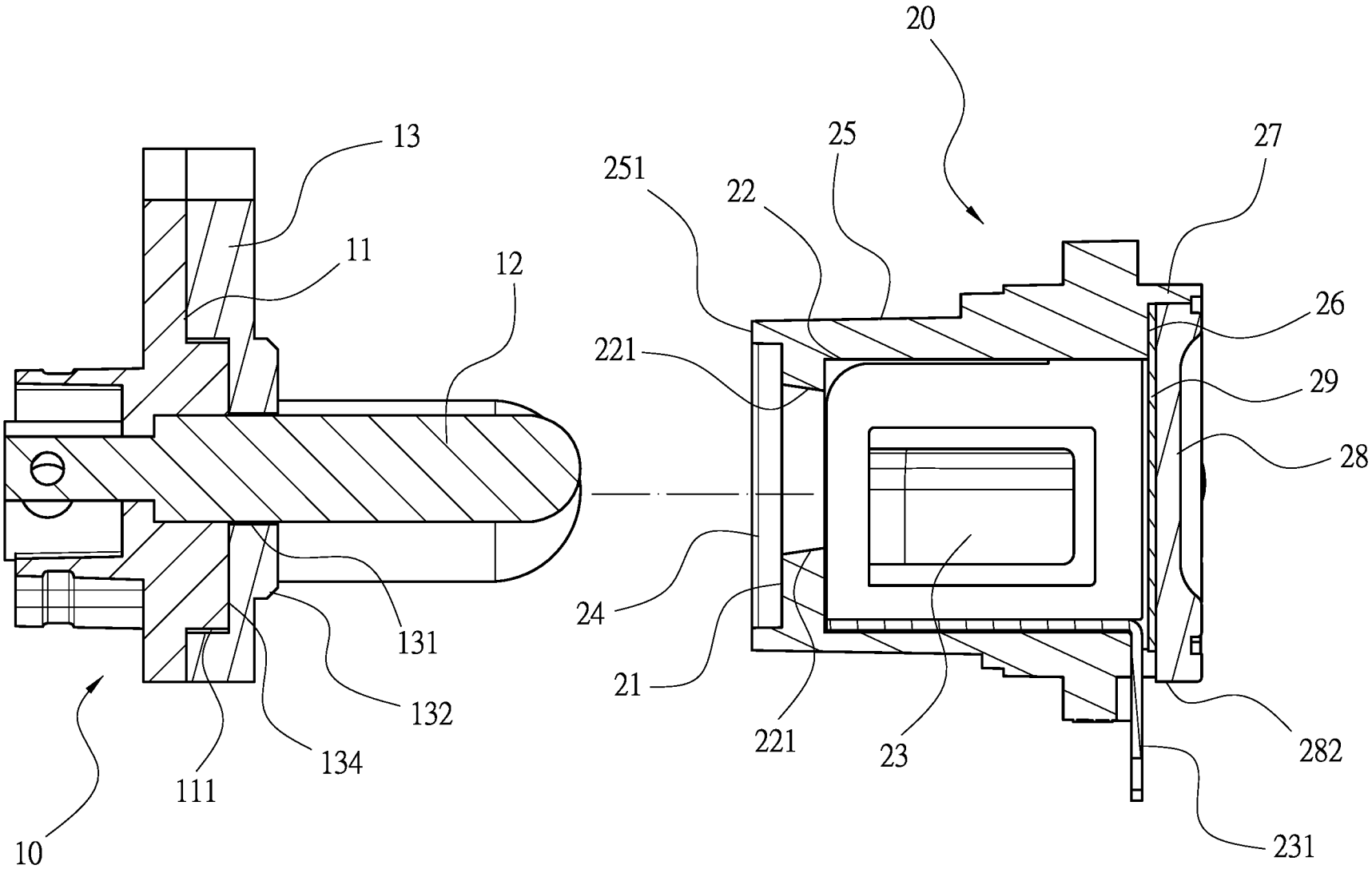
FIG. 5 is a first schematic view of the blade type electrical connector of the present invention when the blade type electrical connector is used.
Figure 6:
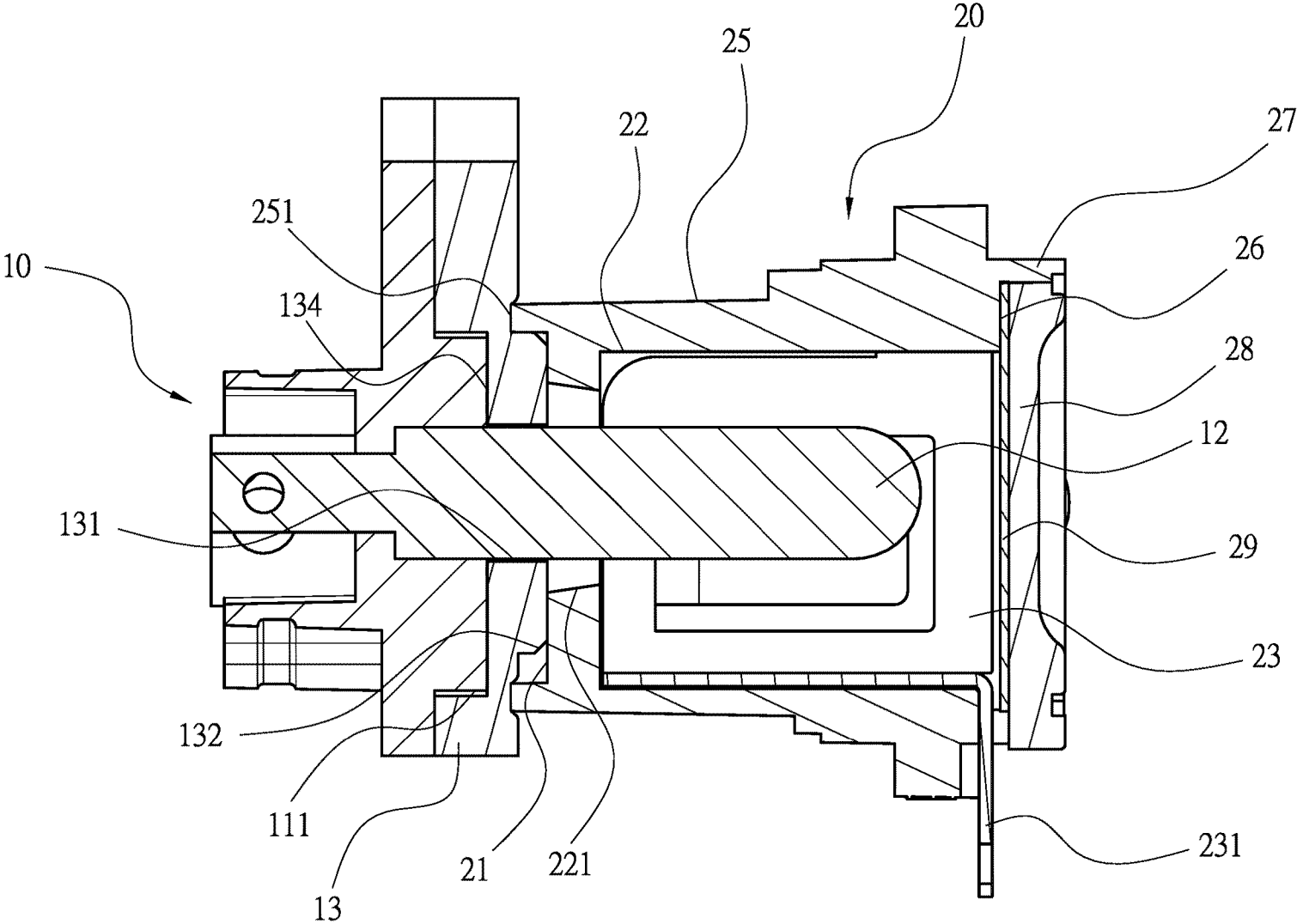
FIG. 6 is a second schematic view of the blade type electrical connector of the present invention when the blade type electrical connector is used.
Figure 7:
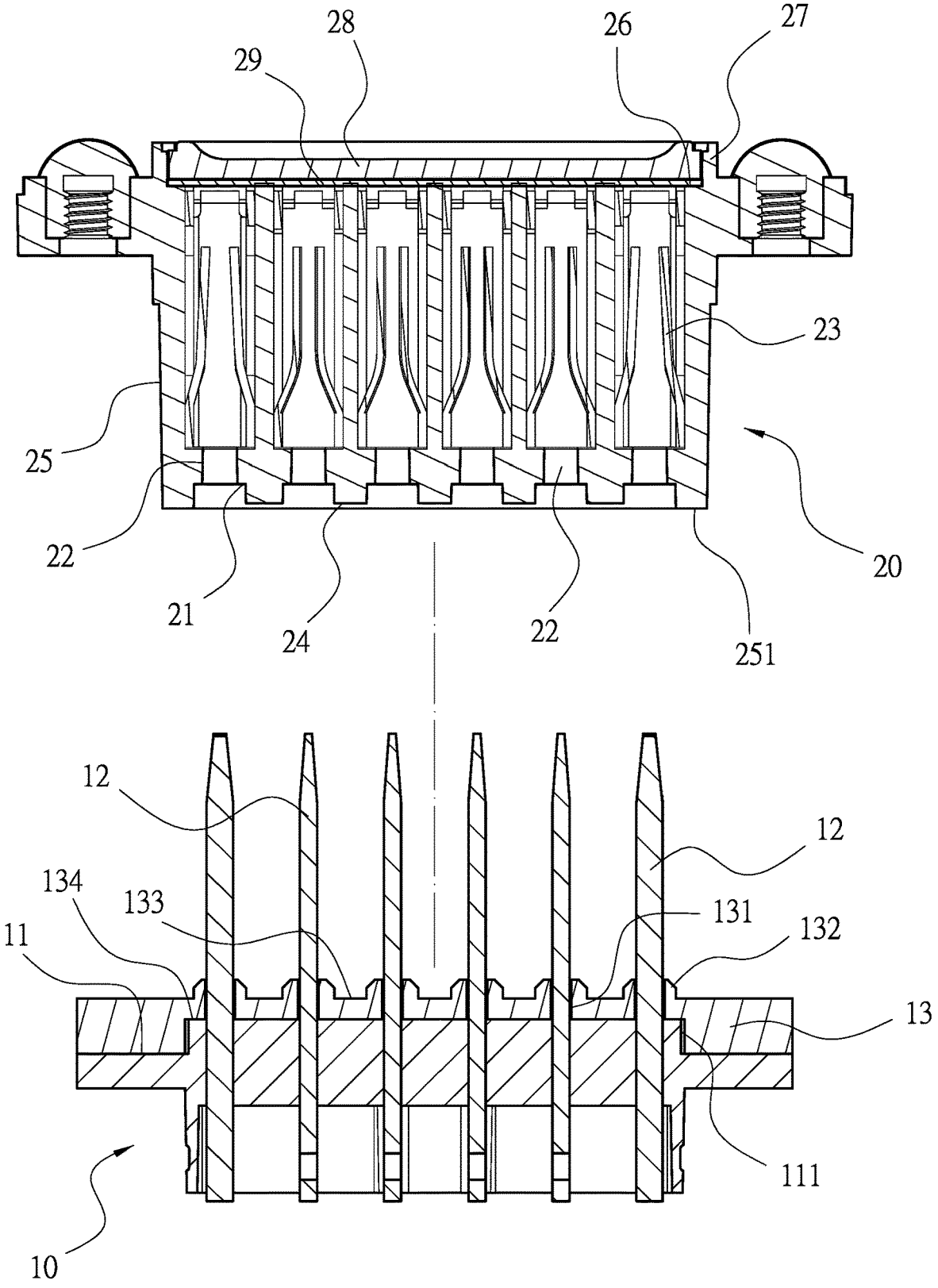
FIG. 7 is a third schematic view of the blade type electrical connector of the present invention when the blade type electrical connector is used.
Figure 8:
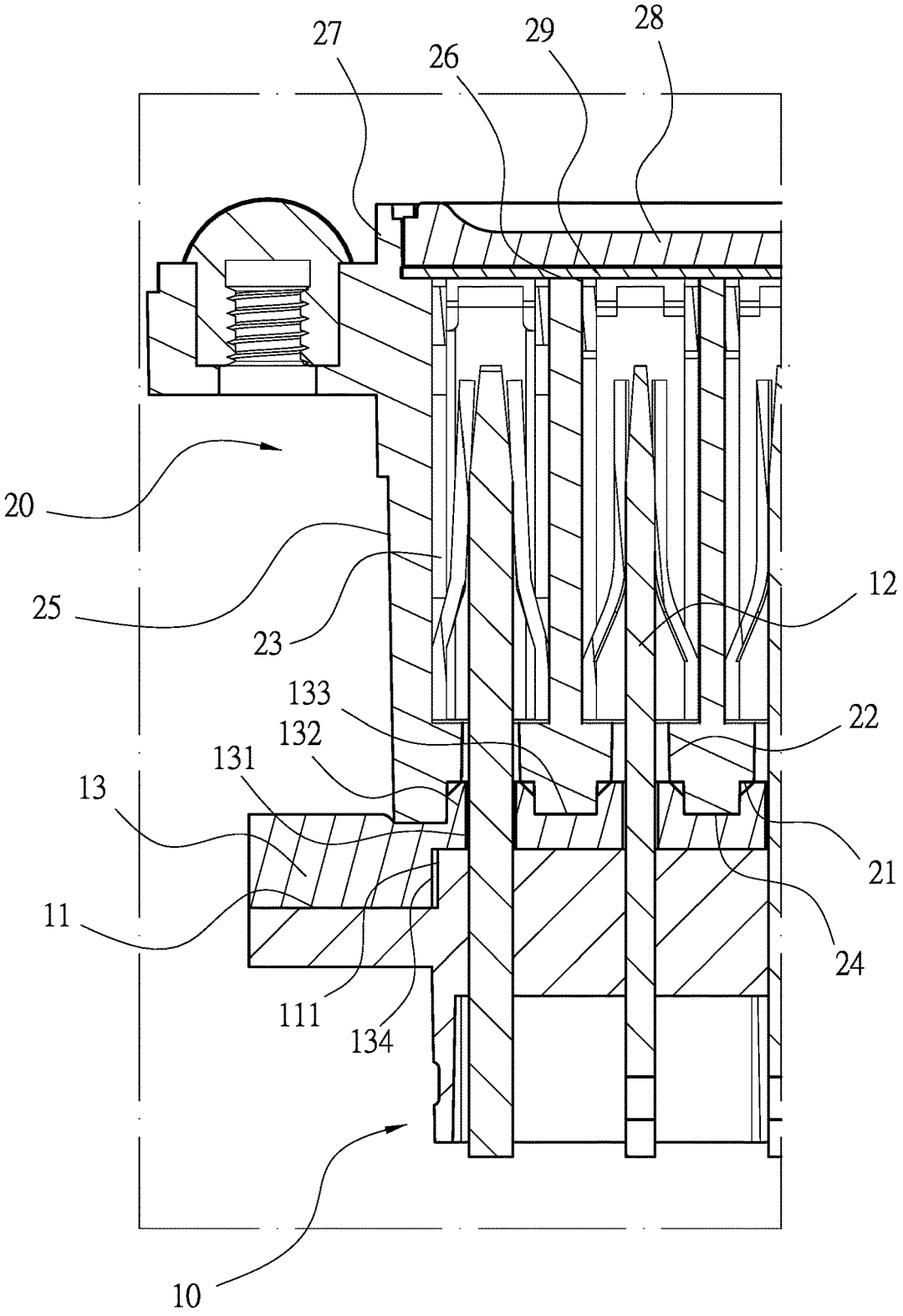
FIG. 8 is a fourth schematic view of the blade type electrical connector of the present invention when the blade type electrical connector is used.

In order to further understand the goal, characteristics and effect of the present invention, a number of embodiments along with the drawings are illustrated as following:

Referring to FIGS. 1 to 3, the present invention provides a blade type electrical connector comprising a first connecting member (10) and a second connecting member (20). The first connecting member (10) has an end surface (11), and a plurality of blades (12) protrude from the end surface (11). A waterproof mat (13) coupled on the end surface (11) has a plurality of first through holes (131) at positions corresponding to the blades (12) so as to allow the blades (12) to penetrate therethrough. A plurality of protruding portions (132) protruding from the surface of waterproof mat (13) are respectively coupled around the outer peripheries of the blades (12), and each two adjacent protruding portions (132) are separated by an interval surface (133). The second connecting member (20), which is formed in box shape, comprises a first surface (21) at one surface thereof, and a plurality of receiving slots (22) are formed on the first surface (21) and extended into the inner space of the second connecting member (20), and each of the receiving slots (22) has a conductive terminal (23) installed therein. Moreover, the second connecting member (20) comprises a plurality of interval bars (24), and each of the interval bars (24) located between two adjacent receiving slots (22) extendedly protrudes from the first surface (21). Furthermore, a blocking wall (25) is provided to surround along the four edges of the first surface (21) so as to cover the first surface (21), the receiving slots (22), the conductive terminals (23), and the interval bars (24). The blocking wall (25) is lateral extended to form a frame (251) which is protruded at position outwardly than the interval bars (24). The blades (12) are configured to respectively insert into the receiving slots (22) to electrically connect to the conductive terminals (23), and the frame (251) is adapted to bear against the waterproof mat (13) such that the depressed waterproof mat (13) is adapted to form the first waterproof protection. Meanwhile, the interval bars (24) are abutted against the interval surfaces (133) to form the second waterproof protection, and the protruding portions (132) of the waterproof mat (13) are abutted against the first surface (21) to form the third waterproof protection, thereby improving the waterproof effect between the first connecting member (10) and the second connecting member (20).

Structurally, referring to FIGS. 1 to 4, the second connecting member (20) has a second surface (26) at the opposed side of the first surface (21), and the second surface (26) is penetrated through by the receiving slots (22), and the conductive terminals (23) are positioned into the receiving slots (22) through the second surface (26). A protruding wall (27) is provided to surround along the four edges of the second surface (26), and a first cover (28) is coupled with the protruding wall (27). Also, a plurality of engaging holes (271) are formed on the protruding wall (27), and the edge of the first cover (28) has a plurality of engaging blocks (281) at positions corresponding to the engaging holes (271). The first cover (28) is coupled with the inner periphery of the protruding wall (27), and the engaging blocks (281) are engaged with the engaging holes (271), so as to achieve the quick assembly of the first cover (28). In addition, an elastic spacer (29) is coupled between the second surface (26) of the second connecting member (20) and the first cover (28), and the spacer (29) is compressed and elastically deformed by the first cover (28) to firmly abut against the second surface (26) so as to achieve the waterproof effect on the second surface (26) of the second connecting member (20). Moreover, the edge of the protruding wall (27) has a plurality of cutting portions (272) aligned with the receiving slots (22), and each of the conductive terminals (23) has a pin (231) extended therefrom such that as the conductive terminals (23) are installed in the receiving slots (22), the pins (231) respectively pass through the cutting portions (272) and are positioned out of the second connecting member (20) to electrically connect to the electric wires. The edge of the first cover (28) comprises a plurality of blocking pieces (282) at positions corresponding to the cutting portions (272) of the protruding wall (27), and the blocking pieces (282) are adapted to respectively fit into the cutting portions (272) when the first cover (28) is coupled in the protruding wall (27). Furthermore, a locating base (111) protrudes from the end surface (11) of the first connecting member (10), and the blades (12) penetrate through the locating base (111). The surface of the waterproof mat (13) faced to the end surface (11) of the first connecting member (10) has a concaved locating slot (134). The blades (12) are configured to penetrate through the first through holes (131) of the waterproof mat (13) respectively and to push the waterproof mat (13) against the end surface (11) of the first connecting member (10), and the locating base (111) is coupled in the locating slot (134), so as to complete the connection between the first connecting member (10) and the second connecting member (20).

In actual application, referring to FIGS. 2, and 5 to 8, each two adjacent receiving slots (22) have one interval bar (24) therebetween, and the interval bars (24) protrude from the first surface (21), Also, the blocking wall (25) is provided to surround along the four edges of the first surface (21) so as to cover the first surface (21), the receiving slots (22), the conductive terminals (23), and the interval bars (24). The blocking wall (25) is lateral extended to form the frame (251) which is protruded at position outwardly than the interval bars (24) so as to form the first surface (21), the interval bars (24), and the frame (251) are positioned at different planes. The blades (12) of the first connecting member (10) are inserted into the receiving slots (22) through the first surface (21) so as to electrically connect to the conductive terminals (23). When the first connecting member (10) is connected to the second connecting member (20), the frame (251) is adapted to bear against and deform the waterproof mat (13) such that the depressed waterproof mat (13) is coupled with the frame (251) to form the first waterproof protection. Also, the waterproof mat (13) is abutted against by the frame (251), and the protruding portions (132) are pushed toward the first surface (21), and the interval bars (24) are abutted against the interval surfaces (133) to form the second waterproof protection. When water passes through the first waterproof protection to leak into one of the receiving slots (22), the interval bars (24) and the interval surfaces (133) are adapted to block the leaking and prevent the water from flowing into the others of the receiving slots (22), so as to avoid the short circuit from happening to the blades (12). Additionally, the protruding portions (132) of the waterproof mat (13) are abutted against the first surface (21) to form the third waterproof protection such that the conductive terminals (23) are protected from the short circuit by the third waterproof protection when the water leaks into the receiving slot (22), thereby improving the waterproof effect between the first connecting member (10) and the second connecting member (20).

Figure 9:
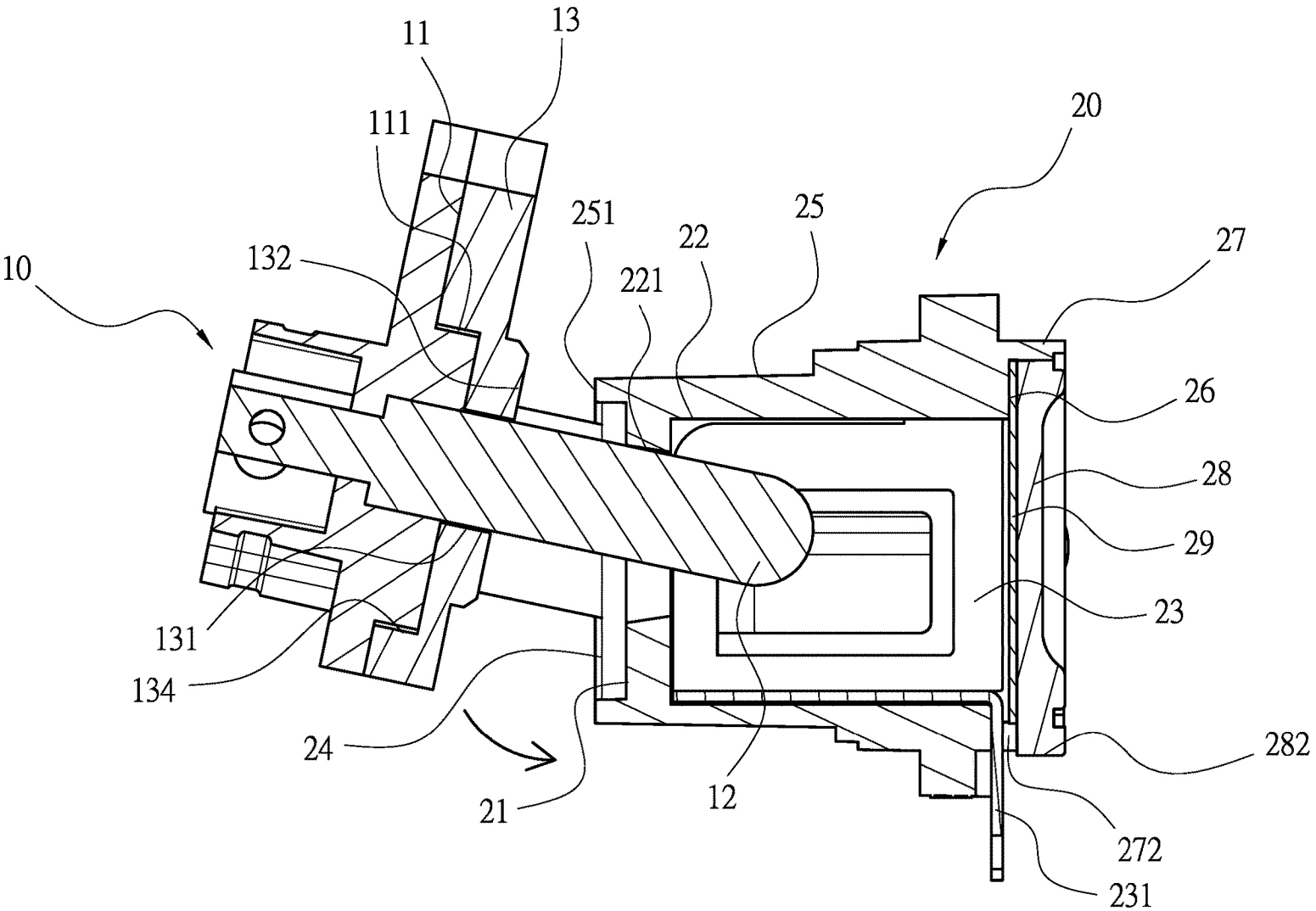
FIG. 9 is a first schematic view of the blade type electrical connector of the present invention when a first connecting member is diagonally inserted into the second connecting member.
Figure 10:
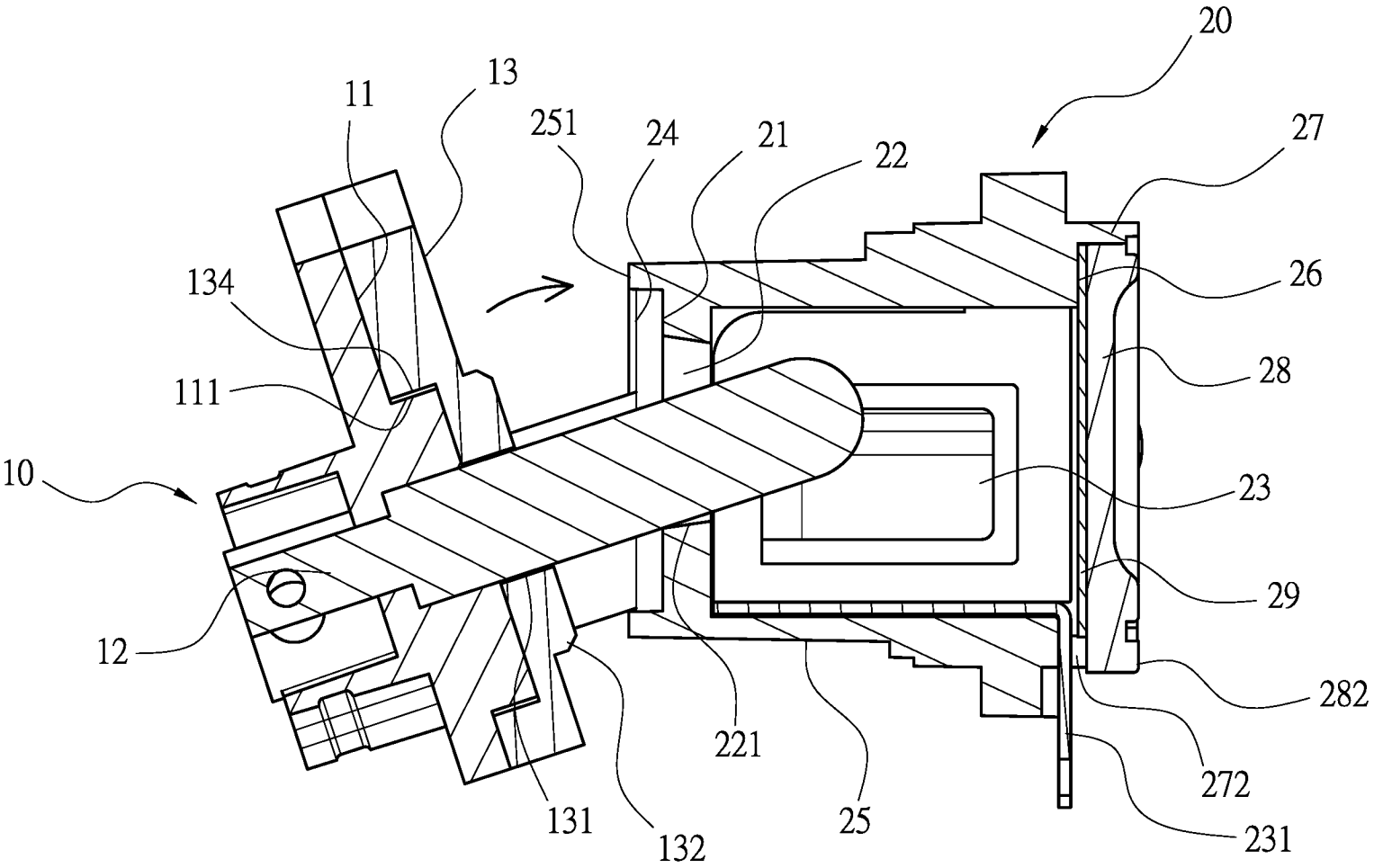
FIG. 10 is a second schematic view of the blade type electrical connector of the present invention when the first connecting member is diagonally inserted into the second connecting member.

Comparing with conventional blade type electrical connector, the present invention is advantageous because: (i) referring to FIGS. 6 and 8, as the first connecting member (10) and the second connecting member (20) are coupled and electrically connected, the waterproof mat (13) is coupled therebetween, and only the blades (12) make contact with the conductive terminals (23), so that the friction between the first connecting member (10) and the second connecting member (20) is effectively reduced so as to improve the operation the insertion and disconnection; and (ii) referring to FIGS. 9 and 10, each of the receiving slots (22) of the second connecting member (20) has two guiding inner walls (221) formed in parallel and located between the first surface (21) and the conductive terminal (23), and the guiding inner wall (221) is inclined from the first surface (21) toward the conductive terminal (23), such that the receiving slots (22) are applicable for wider insertion angles of the blades (12).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A blade type electrical connector comprising a first connecting member and a second connecting member;

wherein the first connecting member has an end surface, and a plurality of blades protrude from the end surface; a waterproof mat coupled on the end surface has a plurality of first through holes at positions corresponding to the blades so as to allow the blades to penetrate therethrough; a plurality of protruding portions protruding from the surface of waterproof mat are respectively coupled around the outer peripheries of the blades, and each two adjacent protruding portions are separated by an interval surface; and wherein the second connecting member, which is formed in box shape, comprises a first surface at one surface thereof, and a plurality of receiving slots are formed on the first surface and extended into the inner space of the second connecting member, and each of the receiving slots has a conductive terminal installed therein; the second connecting member comprises a plurality of interval bars, and each of the interval bars located between two adjacent receiving slots extendedly protrudes from the first surface; a blocking wall is provided to surround along the four edges of the first surface so as to cover the first surface, the receiving slots, the conductive terminals, and the interval bars, and the blocking wall is lateral extended to form a frame which is protruded at position outwardly than the interval bars; the blades are configured to respectively insert into the receiving slots to electrically connect to the conductive terminals, and the frame is adapted to depress the waterproof mat such that the depressed waterproof mat is adapted to form the first waterproof protection; the interval bars are abutted against the interval surfaces to form the second waterproof protection, and the protruding portions of the waterproof mat are abutted against the first surface to form the third waterproof protection.

2. The blade type electrical connector of claim 1, wherein the second connecting member has a second surface at the opposed side of the first surface, and the second surface is penetrated through by the receiving slots, and a protruding wall is provided to surround along the four edges of the second surface, and a first cover is coupled with the protruding wall.

3. The blade type electrical connector of claim 2, wherein a plurality of engaging holes are formed on the protruding wall, and the edge of the first cover has a plurality of engaging blocks at positions corresponding to the engaging holes; and the first cover is coupled with the inner periphery of the protruding wall, and the engaging blocks are engaged with the engaging holes.

4. The blade type electrical connector of claim 3, wherein an elastic spacer is coupled between the second surface of the second connecting member and the first cover, and the spacer is compressed and elastically deformed by the first cover to firmly abut against the second surface.

5. The blade type electrical connector of claim 3, wherein the edge of the protruding wall has a plurality of cutting portions aligned with the receiving slots, and each of the conductive terminals has a pin extended therefrom, and as the conductive terminals are installed in the receiving slots, the pins respectively pass through the cutting portions and are positioned out of the second connecting member.

6. The blade type electrical connector of claim 5, wherein the edge of the first cover comprises a plurality of blocking pieces at positions corresponding to the cutting portions of the protruding wall, and the blocking pieces are adapted to respectively fit into the cutting portions when the first cover is coupled in the protruding wall.

7. The blade type electrical connector of claim 1, wherein a locating base protrudes from the end surface of the first connecting member, and the blades penetrate through the locating base; and the surface of the waterproof mat faced to the end surface of the first connecting member has a concaved locating slot, and the locating base is coupled and secured in the locating slot.

8. The blade type electrical connector of claim 1, wherein each of the receiving slots of the second connecting member has two guiding inner walls formed in parallel and located between the first surface and the conductive terminal, and the guiding inner wall is inclined from the first surface toward the conductive terminal.

9. The blade type electrical connector of claim 1, wherein as the first connecting member and the second connecting member are coupled and electrically connected, the waterproof mat is coupled therebetween, and only the blades make contact with the conductive terminals.

* * * * *